US009302746B2

(12) United States Patent
Foo et al.

(10) Patent No.: US 9,302,746 B2
(45) Date of Patent: Apr. 5, 2016

(54) SYSTEM AND METHOD FOR DISPLACING AN OPERATING ENVELOPE OF AN OFFLOADING SYSTEM IN AN OFFSHORE ENVIRONMENT

(71) Applicants: Kok Seng Foo, Singapore (SG); Alex Kah Keong Tan, Singapore (SG)

(72) Inventors: Kok Seng Foo, Singapore (SG); Alex Kah Keong Tan, Singapore (SG)

(73) Assignee: KEPPEL OFFSHORE & MARINE TECHNOLOGY CENTRE PTE LTD, Singapore (SG)

( * ) Notice: Subject to any disclaimer, the term of this patent is extended or adjusted under 35 U.S.C. 154(b) by 148 days.

(21) Appl. No.: 14/204,520

(22) Filed: Mar. 11, 2014

(65) Prior Publication Data

US 2014/0251493 A1 Sep. 11, 2014

Related U.S. Application Data

(60) Provisional application No. 61/776,390, filed on Mar. 11, 2013.

(51) Int. Cl.

| | |
|---|---|
| ***B67C 3/26*** | (2006.01) |
| ***B63B 27/34*** | (2006.01) |
| ***B63B 27/24*** | (2006.01) |
| *B67D 9/02* | (2010.01) |
| *B63B 22/02* | (2006.01) |
| *B63B 25/12* | (2006.01) |
| *E02B 17/02* | (2006.01) |

(52) U.S. Cl.

CPC ..... *B63B 27/34* (2013.01); *B63B 27/24* (2013.01); *B63B 22/021* (2013.01); *B63B 25/12* (2013.01); *B67D 9/02* (2013.01); *E02B 17/021* (2013.01)

(58) Field of Classification Search

CPC ..... B63B 22/012; B63B 27/24; B63B 27/34; B67D 9/00; B67D 9/02

USPC ..... 141/1, 279, 284, 387, 388

See application file for complete search history.

(56) References Cited

U.S. PATENT DOCUMENTS

2012/0067434 A1* 3/2012 Foo ..... B67D 9/00 137/15.01

* cited by examiner

*Primary Examiner* — Jason K Niesz

(74) *Attorney, Agent, or Firm* — John P. White; Cooper & Dunham LLP

(57) ABSTRACT

During an offloading operation between a first and a second body, an operating envelope of an offloading system can be displaced to compensate for a drifting movement of one of the bodies. By appropriately displacing the operating envelope, offloading operation can continue under safe conditions even though the working limit of the original operating envelope is breached due to the drifting movement of one of the bodies.

5 Claims, 15 Drawing Sheets

SYSTEM AND METHOD FOR DISPLACING AN OPERATING ENVELOPE OF AN OFFLOADING SYSTEM IN AN OFFSHORE ENVIRONMENT

CROSS-REFERENCE TO RELATED APPLICATIONS

This application is claims priority of U.S. Provisional Application No. 61/776,390, filed Mar. 11, 2013, the content of which is hereby incorporated by reference in its entirety.

BACKGROUND

1. Technical Field

Embodiments of the invention relate to system and method for displacing an operating envelope of an offloading system to ensure continuity of offloading operation without compromising on safety.

2. Description of Related Art

Presently, transferring or offloading of hydrocarbon fluid between two bodies in an offshore environment is commonly carried out using mechanical loading arms or cryogenic flexible hoses. These and other existing offloading apparatuses are inherently limited by its operating envelope.

FIG. 1 illustrates the top view representation of an operating envelope of an existing offloading apparatus provided on a first body (e.g. jack-up platform 10). The offloading apparatus may be represented by an offloading origin point 12. The operating envelope 14 defines a maximum working area around the offloading origin point 12 for safe offloading between the first body and a second body (e.g. marine vessel) (not shown). In an offloading operation, the first and the second bodies are connected via hoses for fluid transfer. Due to offshore environmental conditions, the second body may drift away from the first body. If the second body drifts within the operating envelope 14, the offloading operation may continue safely. However, if the second body drifts to a position at the working limit 15 of the operating envelope 14, the offloading operation has to be terminated by emergency shutdown procedures. Any further drifting of the second body to a position beyond the operating envelope 14 (e.g. at position 16) would activate emergency disconnection procedures to separate the transfer hose from the second body before the mechanical limit 17 of the offloading apparatus is reached.

SUMMARY

According to one aspect of the invention, an offloading system comprises: a cantilever mounted on a deck, the cantilever is movable in a longitudinal direction of the cantilever between a retracted position and an extended position, the cantilever having an operational end which extends beyond the deck in the extended position; a transverse platform mounted on the operational end of the cantilever and movable between a transverse direction of the cantilever; a plurality of transfer hoses having a first end connected to a hydrocarbon fluid storage and having a second end to be connected to a marine vessel for fluid transfer between the hydrocarbon fluid storage and the marine vessel; and a transfer hose handling system mounted on the transverse platform and operable to manipulate the plurality of transfer hoses to and from the marine vessel, wherein after connecting the plurality of transfer hoses to the marine vessel, the transverse platform is movable in the transverse direction of the cantilever to adjust a transverse reach of the transverse platform and/or the cantilever is movable in the longitudinal direction of the cantilever to displace an operating envelope of the offloading system. The offloading system may be provided on a fixed or moving body.

According to another aspect of the invention, a method for displacing an operating envelope of an offloading system, comprises: positioning a marine vessel at a distance from a jack-up platform having an offloading system which comprises: a cantilever mounted on a deck of the jack-up platform, the cantilever being movable in a longitudinal direction of the cantilever between a retracted position and an extended position, the cantilever having an operational end which extends beyond the deck in the extended position, a transverse platform mounted on the operational end of the cantilever and movable along a transverse direction of the cantilever, and a plurality of transfer hoses, each having a first end connected to a hydrocarbon fluid storage and each having a second end to be connected to the marine vessel for fluid transfer between the hydrocarbon fluid storage and the marine vessel; a transfer hose handling system mounted on the transverse platform and operable to manipulate the plurality of transfer hoses to and from the marine vessel; extending the operational end of the cantilever in the longitudinal direction towards the marine vessel; connecting the plurality of transfer hoses to the marine vessel; and displacing an operating envelope of the offloading system by moving the transverse platform in the transverse direction to adjust a transverse reach of the transverse platform and/or by moving the cantilever in the longitudinal direction to adjust a longitudinal reach of the cantilever.

The method may further comprise returning the marine vessel to a pre-drifted position; and returning the displaced operating envelope of the offloading system to the pre-drifted position by moving the transverse platform in the transverse direction to adjust a transverse reach of the transverse platform and/or by moving the cantilever in the longitudinal direction to adjust a longitudinal reach of the cantilever.

As will be apparent from the present disclosure, embodiments of the invention are capable of displacing an operating envelope of an offloading system which is to transfer hydrocarbon between a first body which is fixed or moving, and a second moving body. The displaced operating envelope is capable of compensating for a displacement of the second body from its original desired position so that a continuing offloading operation may not need to be disrupted due to a breach of the working limit of the original operating envelope. Accordingly, by displacing an operating envelope to a new position, safety standards for offloading operation can be maintained while reducing offloading downtime.

BRIEF DESCRIPTION OF THE DRAWINGS

Embodiments of the invention are disclosed hereinafter with reference to the drawings, in which:

FIGS. 5A to 5K illustrate a method of displacing an operating envelope of an offloading system, in which:

FIG. 5A illustrates a cantilever of the offloading system disposed in a retracted position, FIG. 5B illustrates a marine vessel maintained in position relative to the jack-up platform, FIG. 5C illustrates the cantilever being extended in a longitudinal (Y) direction towards the marine vessel, FIG. 5D illustrates the transfer hoses having moved onto the marine vessel and connected to the manifolds on the marine vessel, FIG. 5E is a close-up view of FIG. 5D, FIG. 5F illustrates the transfer hoses connected to the manifolds of the marine vessel and the transfer skid disconnected from the transfer hose handling system on the jack-up platform while slack ropes or wires connect the ERCs of the transfer hoses to the transfer hose handling system, FIG. 5G is a close-up view of FIG. 5F, FIG. 5H illustrates the arrangement of the offloading system when an offloading operation is taking place, FIG. 5I is a simplified top view of FIG. 5H and illustrates an original operating envelope of the offloading system, FIG. 5J shows that the marine vessel has drifted from the original position illustrated in FIG. 5I to a new position relative to the jack-up platform, and FIG. 5K illustrates a new or displaced operating envelope.

DETAILED DESCRIPTION

Figure 1:
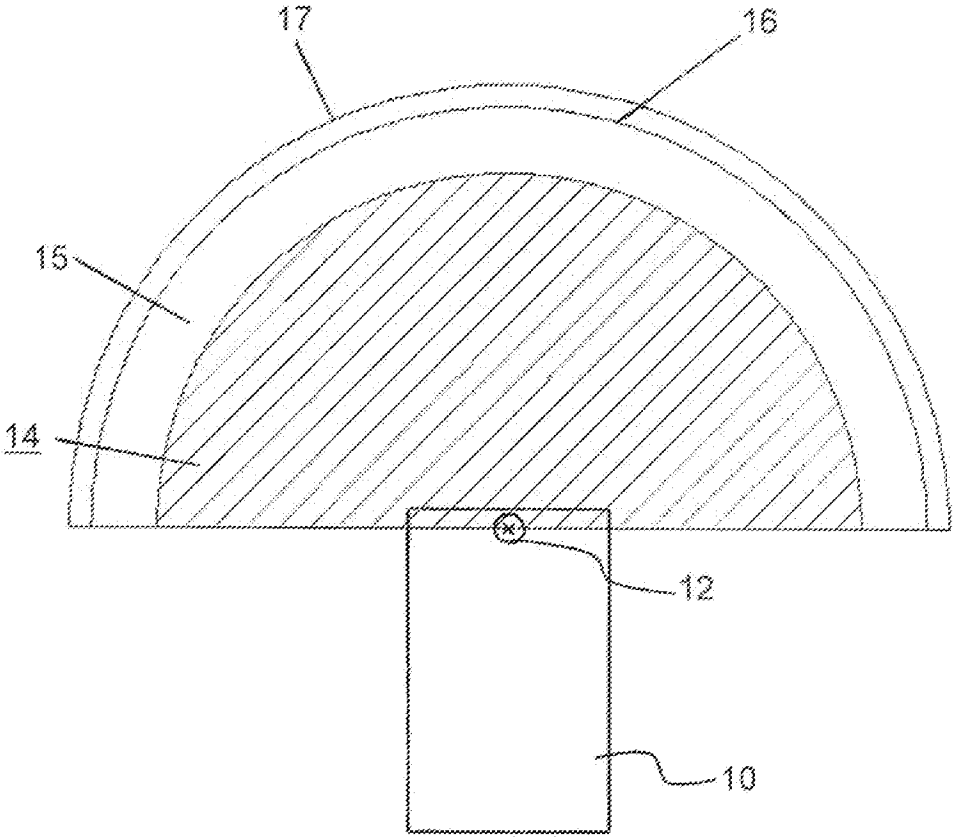
FIG. 1 illustrates an operating envelope of an existing offloading apparatus.

In the following description, numerous specific details are set forth in order to provide a thorough understanding of various illustrative embodiments of the invention. It will be understood, however, to one skilled in the art, that embodiments of the invention may be practiced without some or all of these specific details. In other instances, well known process operations have not been described in detail in order not to unnecessarily obscure pertinent aspects of embodiments being described. In the drawings, like reference numerals refer to same or similar functionalities or features throughout the several views.

Figure 2:
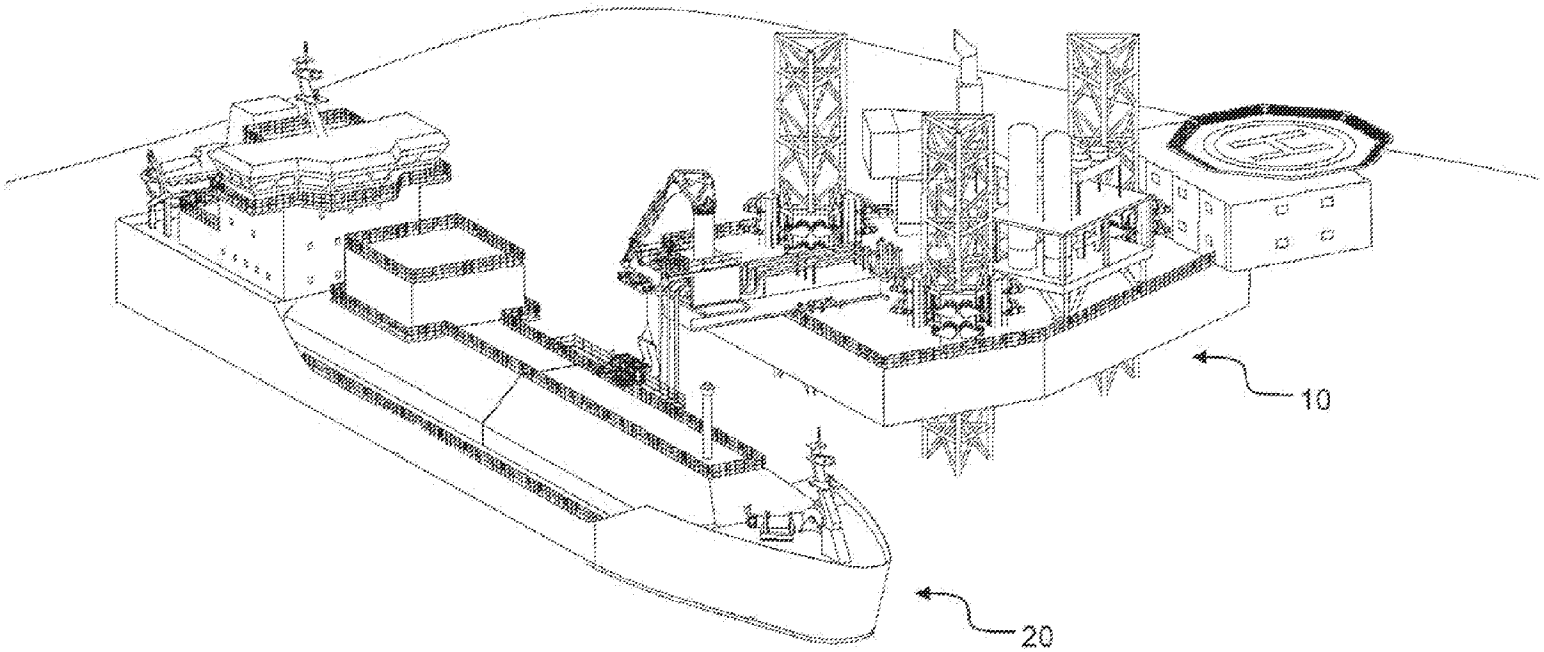
FIG. 2 is an overview arrangement of a jack-up platform and a marine vessel for a hydrocarbon fluid transfer or offloading operation.

FIG. 2 is an overview arrangement of a first body, e.g. jack-up platform 10, and a second body, e.g. marine vessel 20 such as a Liquefied Natural Gas (LNG) carrier or tanker, for a hydrocarbon fluid transfer or offloading operation. The jack-up platform 10 may be provided with gas processing, liquefaction, and/or hydrocarbon fluid storage facilities. The marine vessel 20 may be maintained in position relative to the jack-up platform 10 by suitable methods, e.g. spread mooring, dynamic positioning.

Figure 3:
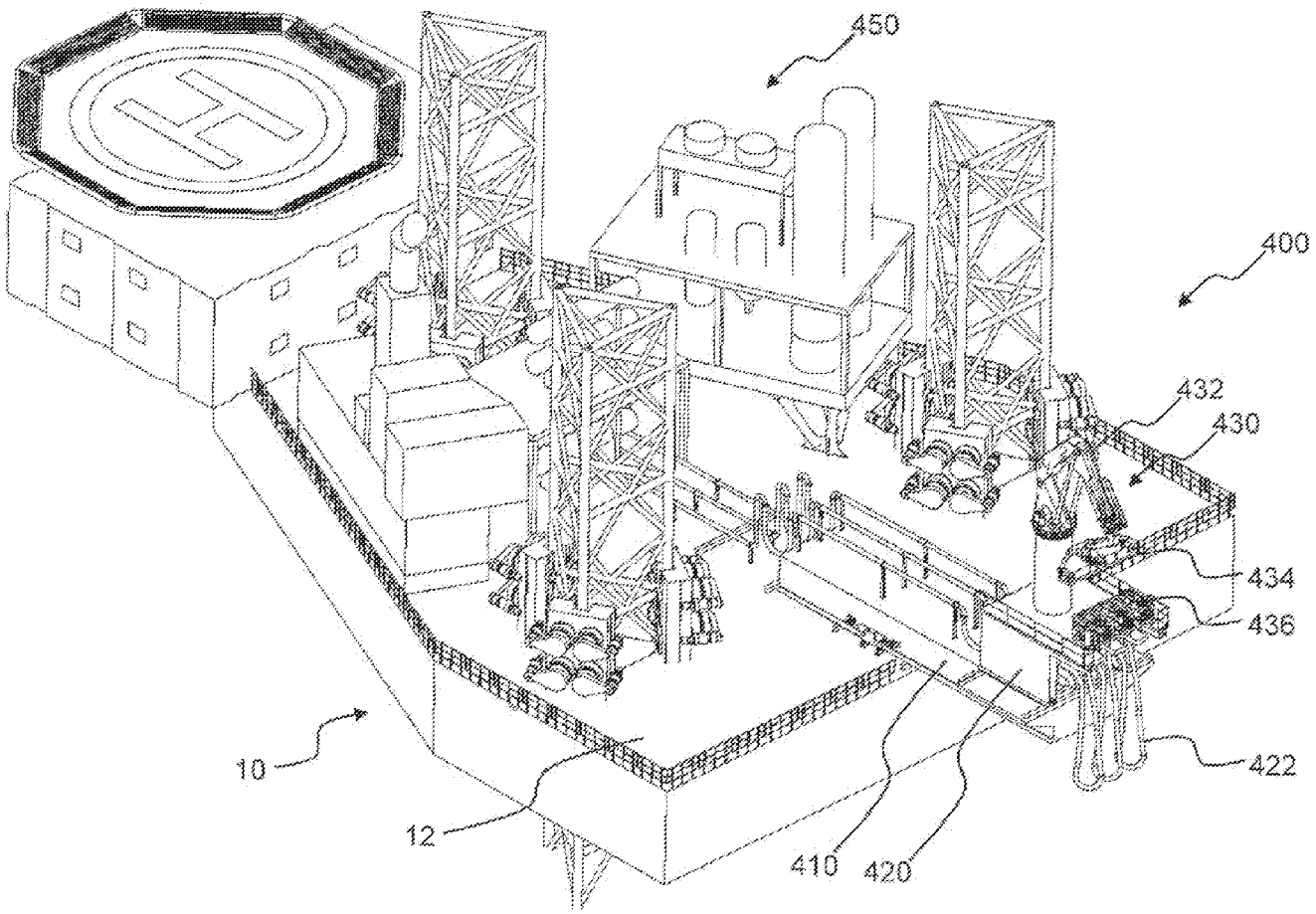
FIG. 3 is a close-up view of the jack-up platform which is provided with an offloading system.
Figure 4:
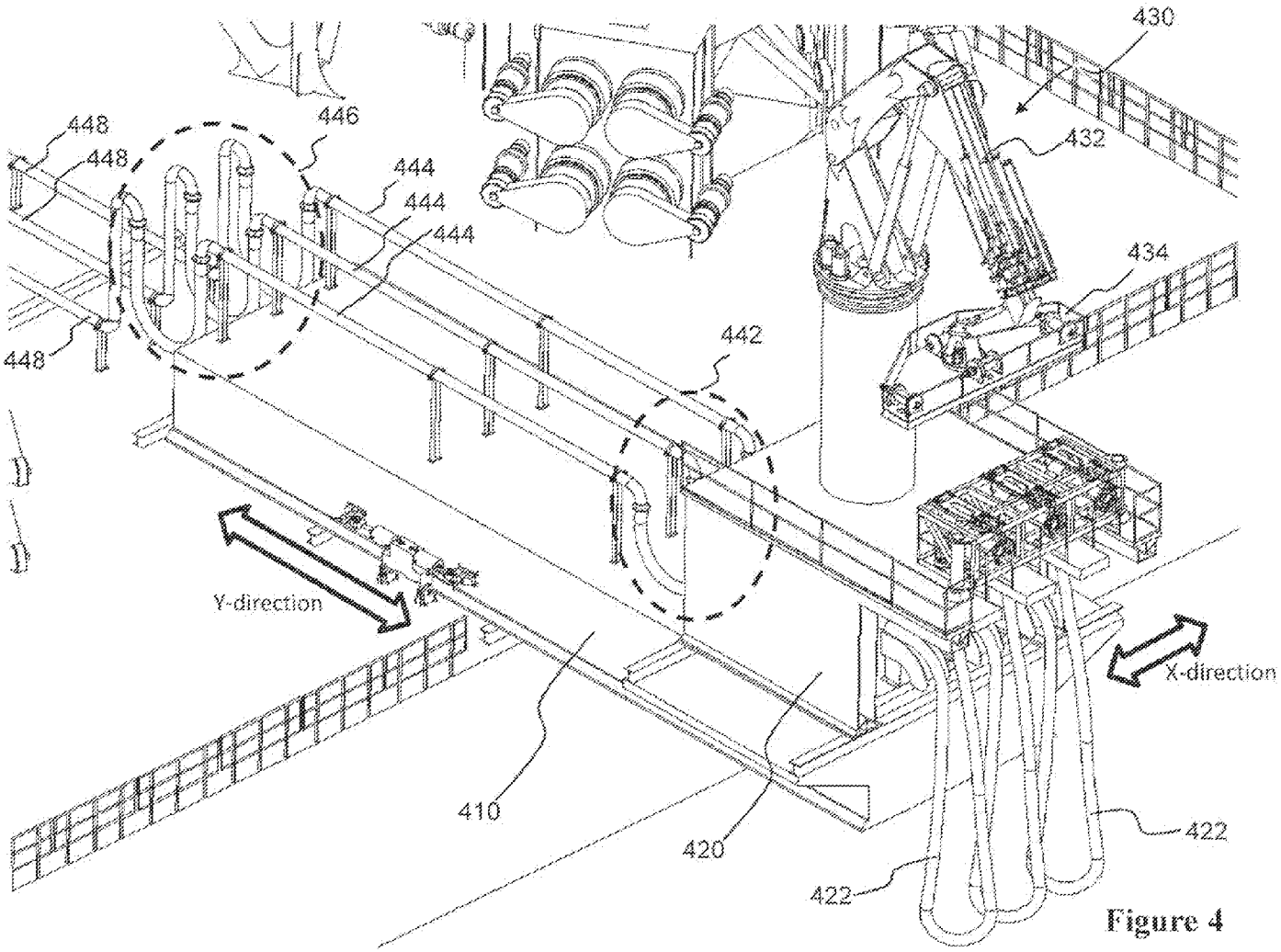
FIG. 4 is a close-up view of the offloading system of FIG. 3.

FIG. 3 is a close-up view of the jack-up platform 10 which is provided with an offloading system 400; FIG. 4 is a close-up view of the offloading system 400.

Referring to FIGS. 3 and 4, the offloading system 400 at least comprises a cantilever 410, a transverse platform 420, a plurality of cryogenic transfer hoses 422 and a transfer hose handling system 430. The cantilever 410 is movably mounted on a deck 12 of the jack-up platform 10. The cantilever 410 is movable or skiddable in a longitudinal direction of the cantilever 410 (Y-direction) between a retracted position and an extended position, including intermediate positions therebetween. The cantilever 410 has an operational end which extends beyond the deck 12. The transverse platform 420 is movably mounted at the operational end of the cantilever 410. The transverse platform 420 is movable or skiddable in a transverse direction of the cantilever 410 (X-direction) between a leftmost position and a rightmost position, including intermediate positions therebetween. The transfer hoses 422 are provided at the transverse platform 420. Each of the transfer hoses 422 has a first end connected to or disposed in fluid communication with a hydrocarbon fluid storage 450 at the jack-up platform 10 and a second end to be connected to a marine vessel 20 to facilitate fluid transfer between the hydrocarbon fluid storage 450 and the marine vessel 20. The transfer hose handling system 430 is provided on the transverse platform 420 and operable to manipulate the plurality of transfer hoses 422 to and from the marine vessel 20.

Upon connecting the plurality of transfer hoses 422 to manifolds of the marine vessel 20, the transverse platform 420 remains movable in a transverse (X) direction of the cantilever 410 between a leftmost position and a rightmost position to adjust a transverse reach of the transverse platform 420. Also, the cantilever 410 remains movable in the longitudinal (Y) direction, to adjust a longitudinal reach of the cantilever 410. By moving the cantilever 410 and/or transverse platform 420 in their respective directions, the operational end of the cantilever 410, including the transfer hose handling system 430 with its transfer hoses 422, is repositioned. This repositioning results in displacing the original operating envelope to a new operating envelope. If the marine vessel 20 is located within the new (or displaced) operating envelope, offloading operation may continue or take place safely. Hence, by displacing an operating envelope when the marine vessel 20 is approaching the working limit of the operating envelope, emergency shutdown and disconnection of the offloading system from the marine vessel may be delayed or even refrained altogether.

Still referring to FIGS. 3 and 4, a plurality of first ends of the transfer hoses 422 may be connected to a hydrocarbon fluid storage 450 via a series of pipes or hoses interposed therebetween. Particularly, the first ends of the transfer hoses 422 are connected to a first plurality of rigid pipes (not shown in FIG. 4, see 440 in FIG. 5E) which are located on the transverse platform 420. The first plurality of rigid pipes 440 are connected to a first plurality of flexible hoses 442 which are in turn connected to a second plurality of rigid pipes 444 which are disposed on the cantilever 410. The first plurality of flexible hoses 442 are arranged with a slack to allow the transverse platform 420 move in a transverse (X) direction to the cantilever 410 without affecting or damaging the second plurality of rigid pipes 444. The second plurality of rigid pipes 444 are connected to a second plurality of flexible hoses 446 which are in turn connected to a third plurality of rigid pipes 448 which are disposed on the deck 12. The second plurality of flexible hoses 446 are arranged with a slack to allow the cantilever 410 move in a longitudinal (Y) direction to the cantilever without affecting or damaging the third plurality of rigid pipes 448. The third plurality of rigid pipes 448 may be connected to the hydrocarbon fluid storage 450 either directly or indirectly through other pipes.

In the illustration of FIG. 4, the transfer hose handling or lifting system 430 comprises an extendable lifting arm 432 having a spreader frame 434 movably attached thereto. The lifting arm 432 and the spreader frame 434 are motorized to manipulate or lift a transfer skid 436 supporting the transfer hoses 422. Particularly, the transfer hose handling system 430 may lift the transfer hoses 422 from a parking position on the transverse platform 420, support the transfer hoses 422 while they are being transferred to a marine vessel 20, lower the transfer hoses 422 onto the marine vessel 20, and return the transfer hoses 422 to the parking position. It is to be appreciated that other types of offloading system, transfer hose handling or lifting system not shown or described herein may be employed with embodiments of the invention. Examples of transfer hose handling system as described in U.S. patent application Ser. No. 13/236,262 filed on 19 Sep. 2011 (published as US 2012-0067434 A1), U.S. patent application Ser. No. 13/407,538 filed on 28 Feb. 2012 (published as US 2012-0230772 A1), and U.S. patent application Ser. No. 13/407,577 filed on 28 Feb. 2012 (published as US 2012-0152366 A1) are incorporated herein by reference.

A method of displacing an operating envelope of an offloading system is described in the following paragraphs with reference to FIGS. 5A to 5K.

Figure 5A:
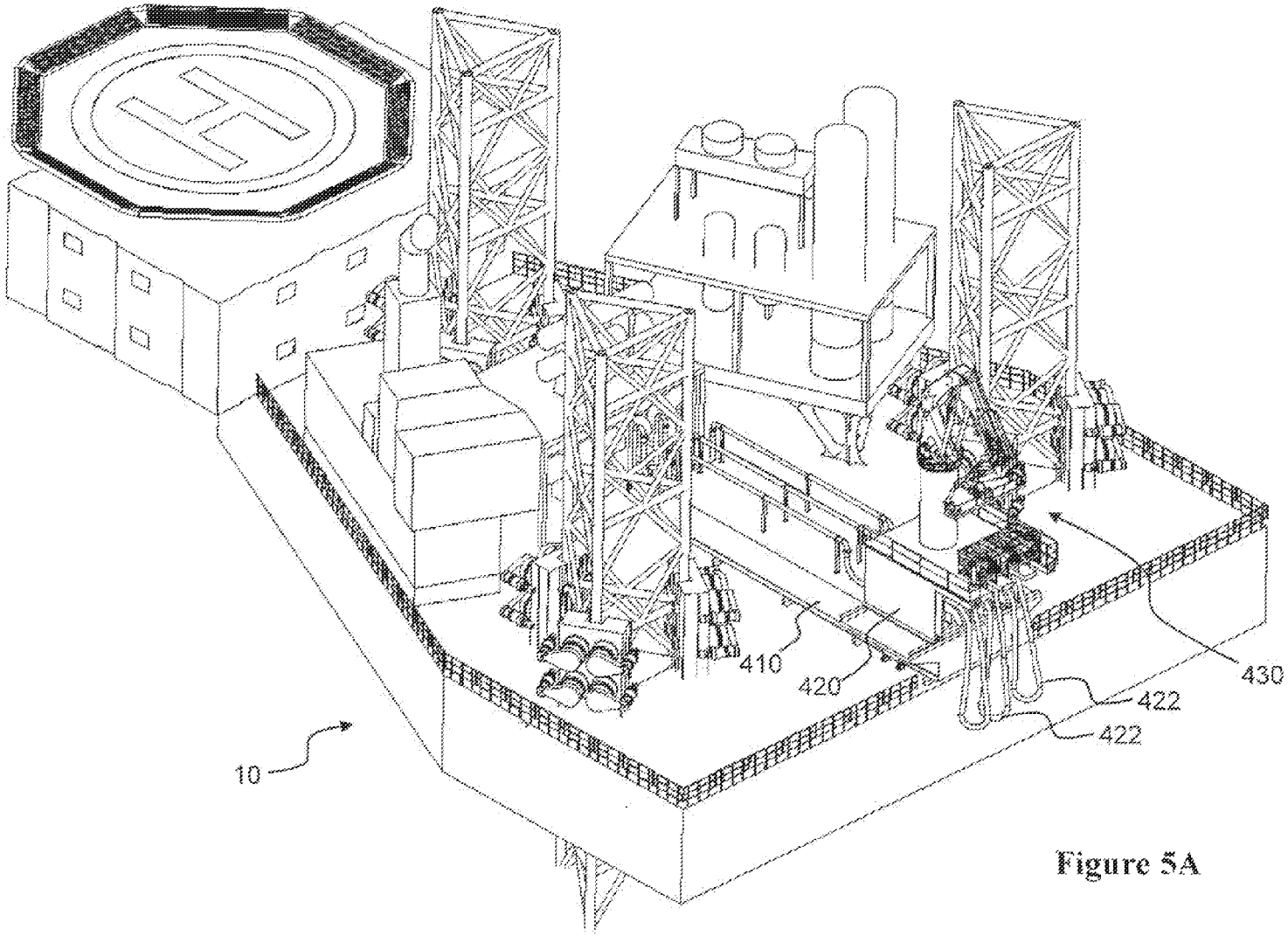
Figure 5B:
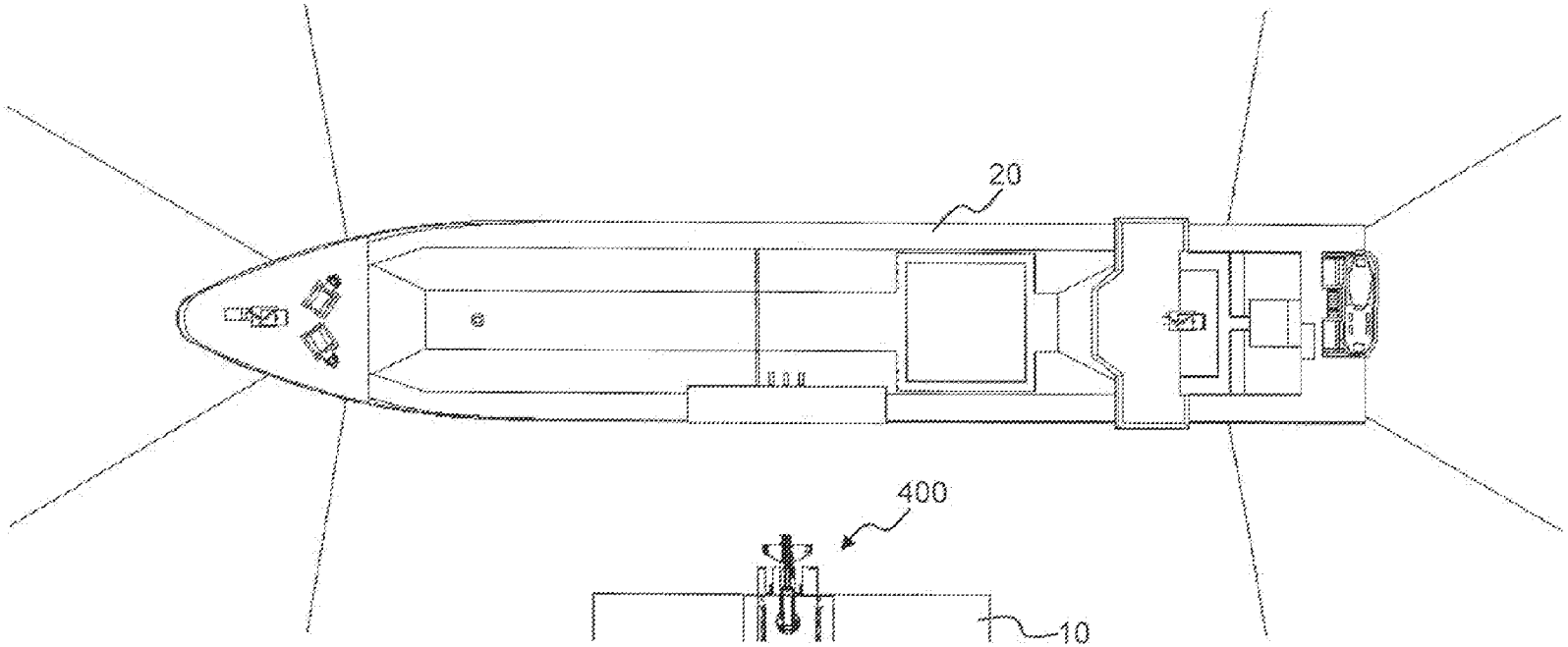
Figure 5C:
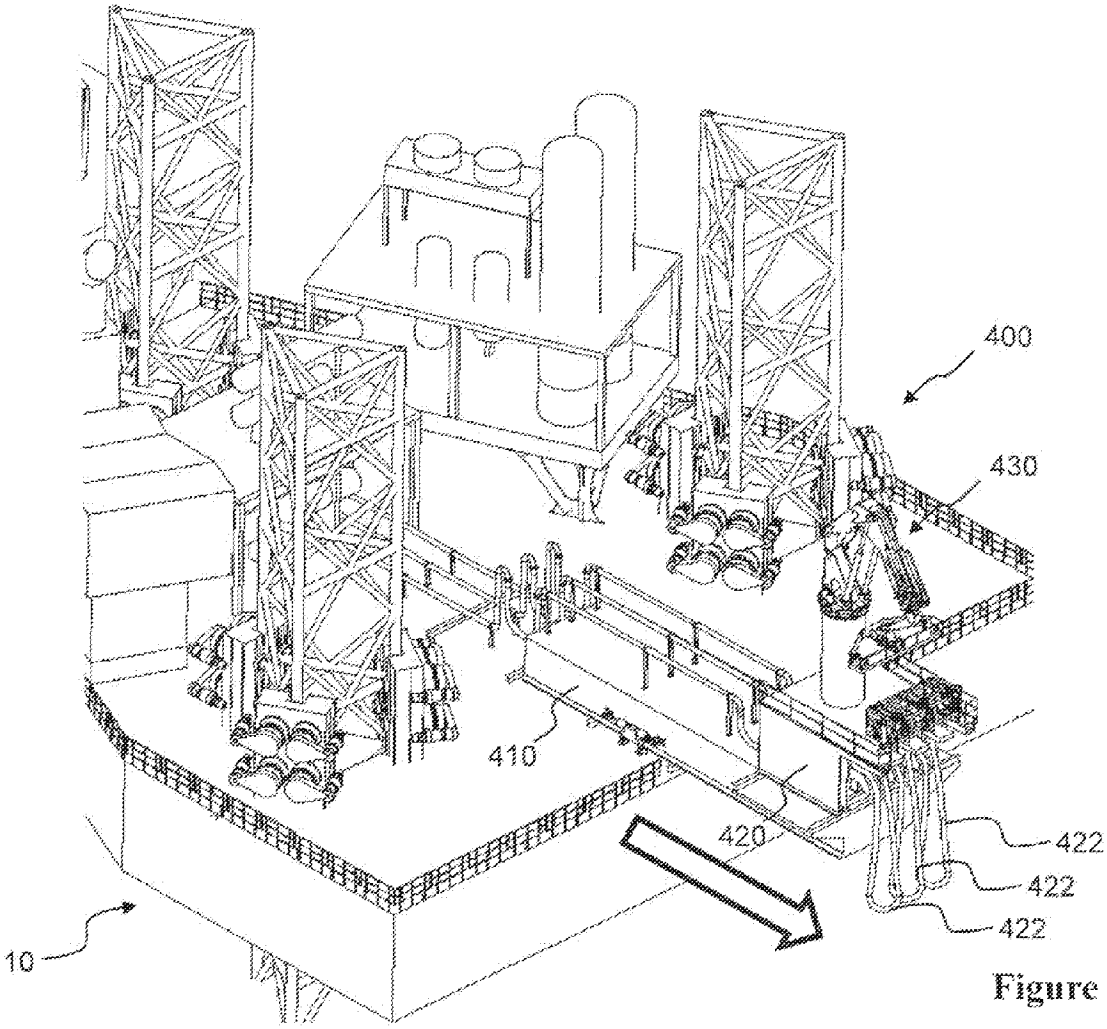
Figure 5D:
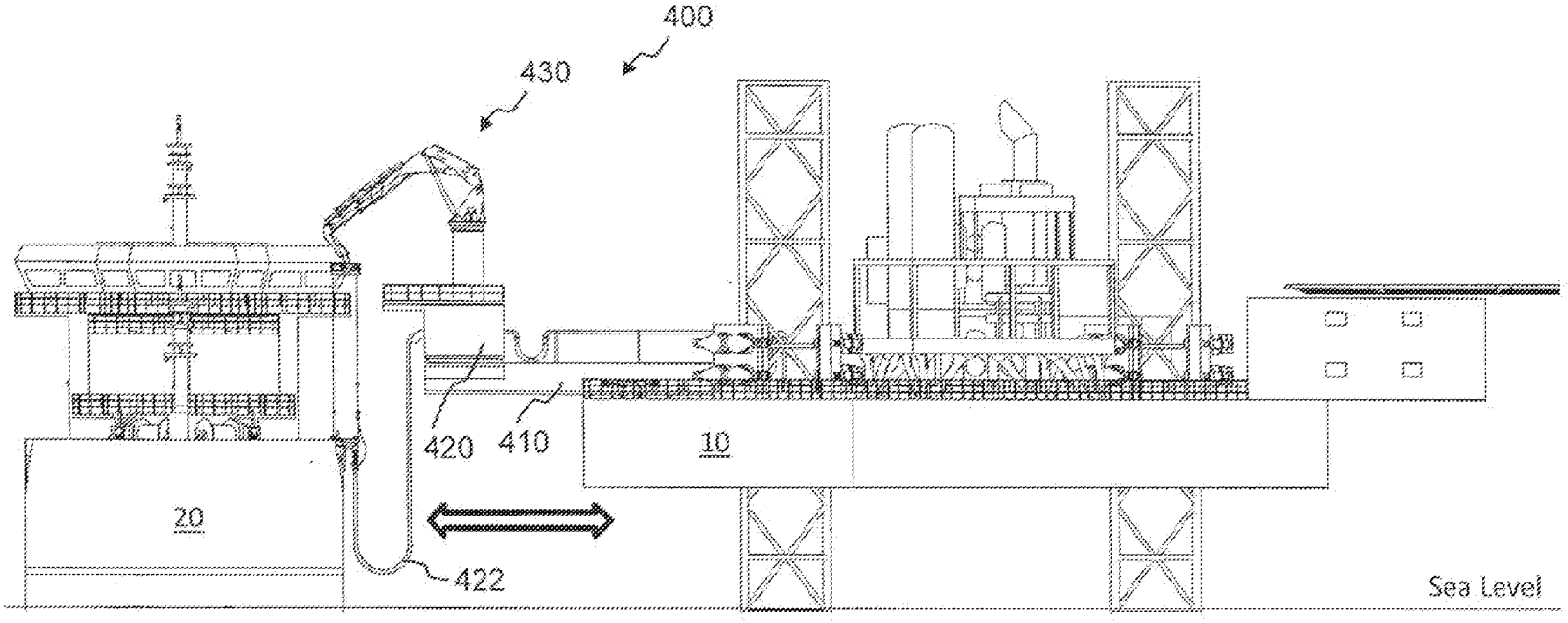
Figure 5E:
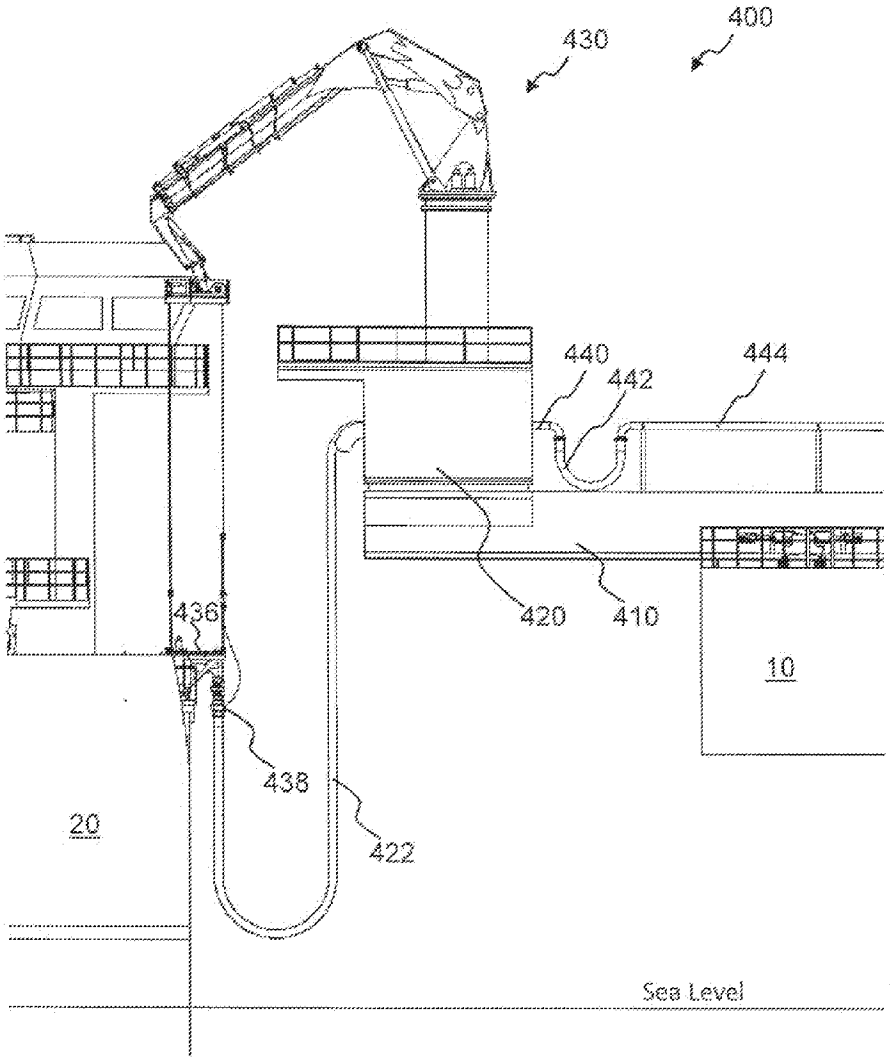

At a jack-up platform 10 provided with an offloading system 400 according to the invention, the cantilever 410 of the offloading system 400 is disposed in a retracted position (see FIG. 5A). A marine vessel 20 approaches the jack-up platform 10 and at an appropriate safety distance from the jack-up platform 10, the marine vessel 20 is maintained in position relative to the jack-up platform 10 by mooring or dynamic positioning (see FIG. 5B).

The offloading system is then prepared for offloading operation. Particularly, the cantilever 410 is extended in a longitudinal (Y) direction towards the marine vessel 20 (see FIG. 5C). Extending the operational end of the cantilever 410 towards the marine vessel 20 moves the transfer hose handling system 430 towards the marine vessel 20. The cantilever 410 and/or the transverse platform 420 may be suitably adjusted (respectively in the Y and X directions) to a desired position relative to the marine vessel 20 before the transfer hoses 422 are transferred or moved over to the marine vessel 20 and connected to the manifolds on the marine vessel 20 (see FIG. 5D and FIG. 5E which is a close-up view of FIG. 5D).

Figure 5F:
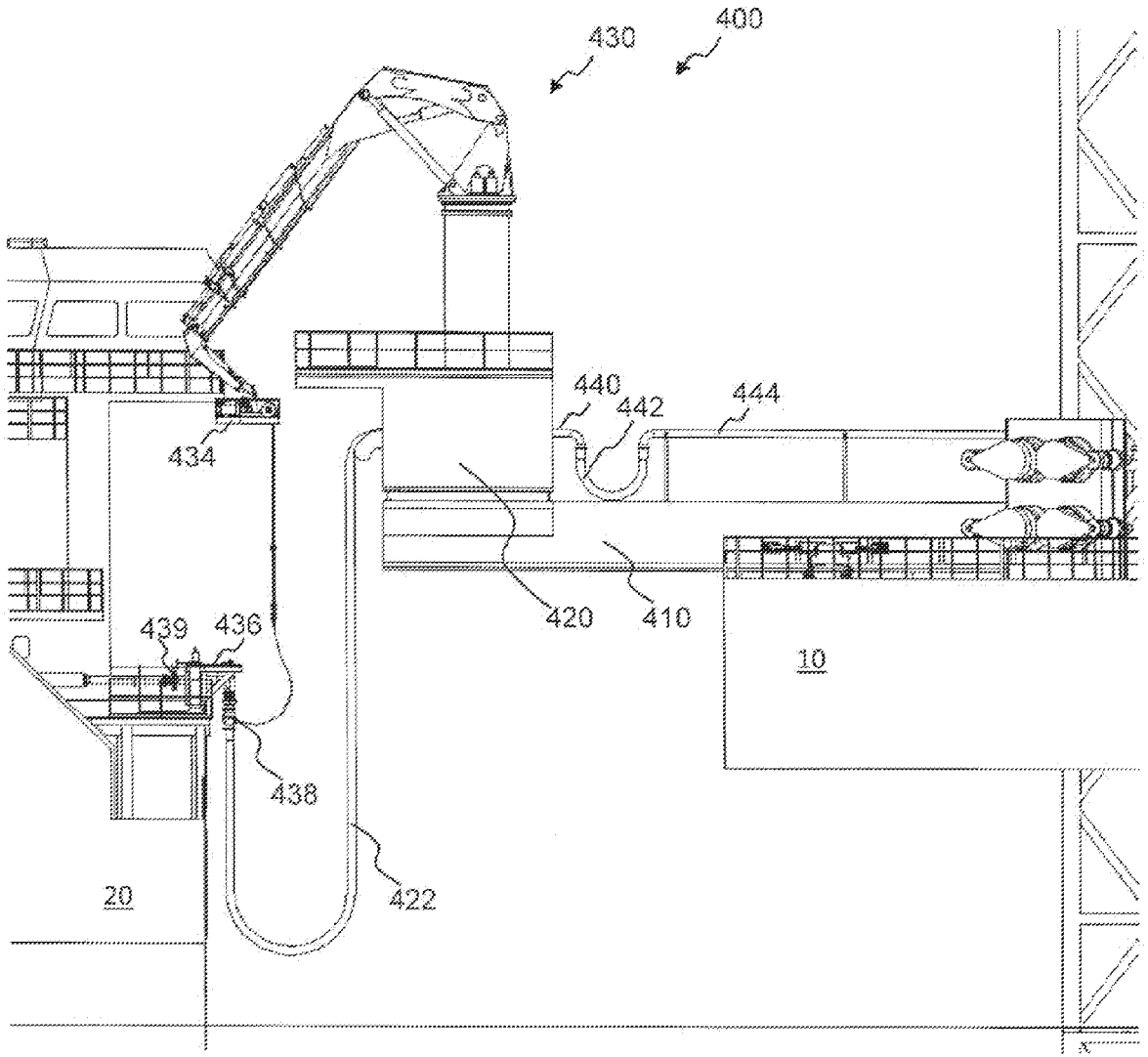
Figure 5G:
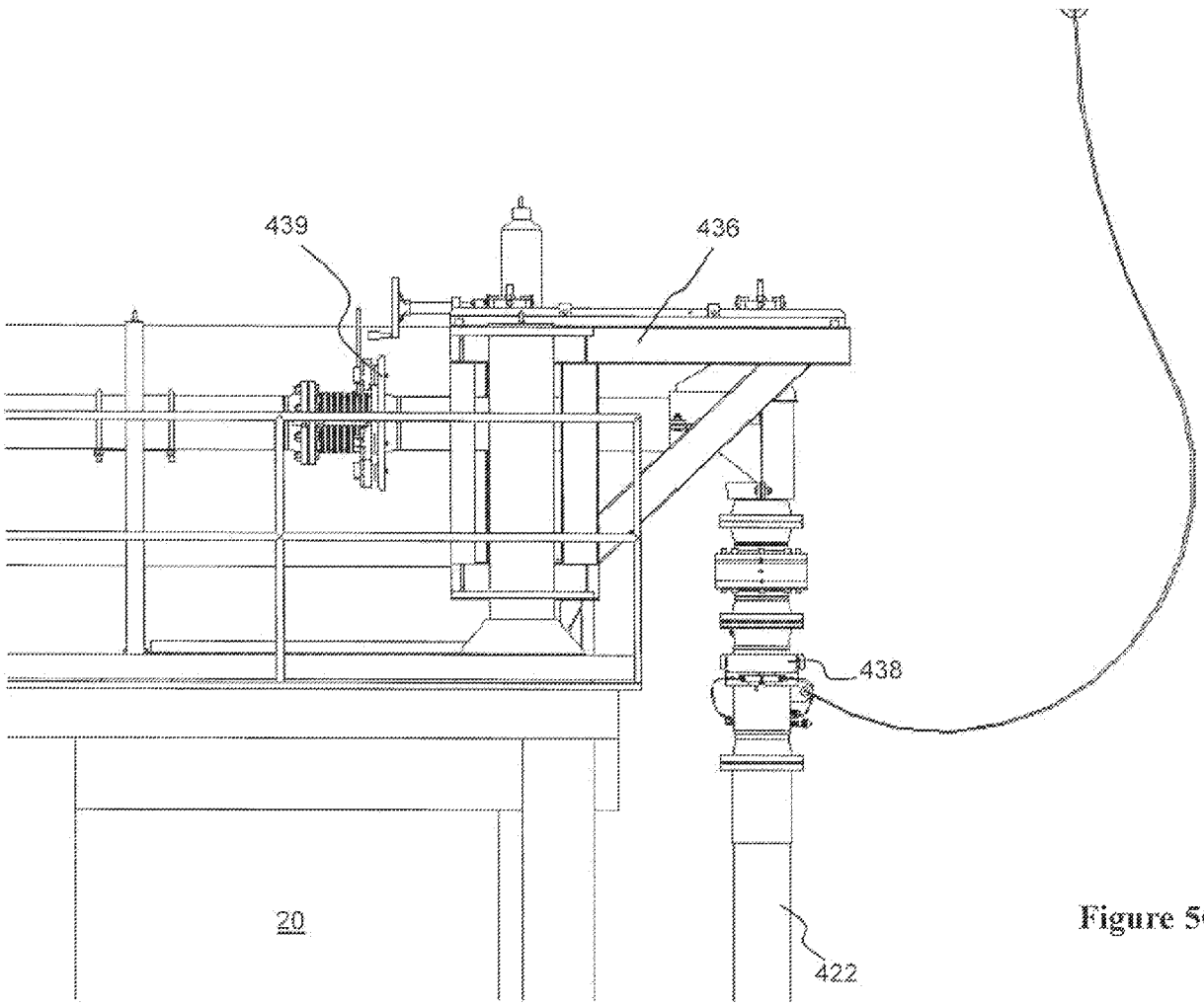

The sequence of transferring or moving the transfer hoses 422 to the marine vessel 20 and connecting to the manifolds depends on the type of hose handling system provided. For illustrative purpose, a transfer hose handling system described by U.S. patent application Ser. No. 13/407,577 (published as US 2012-0152366 A1) is used here. It is to be appreciated that other types of transfer hose handling system may be suitably deployed with embodiments of the present invention. In FIGS. 5F and 5G which is a close-up view of FIG. 5F, the transfer hoses 422 are supported by a transfer skid 436. Quick Connect/Disconnect Couplers (QCDCs) 439 are provided in the transfer skid 436 to connect the transfer hoses 422 to the manifolds of the marine vessel 20. Emergency Release Couplers (ERCs) 438 which allow quick disconnection of the transfer hoses 422 from the marine vessel 20 during emergency conditions are also provided at the transfer hoses 422. FIG. 5F illustrates the transfer hoses 422 connected to the manifolds of the marine vessel 20 and the transfer skid 436 disconnected from the transfer hose handling system 430 on the jack-up platform 10 while slack ropes or wires connect the ERCs 438 of the transfer hoses 422 to the transfer hose handling system 430. The slack ropes allow the transfer hoses 422 to be retrieved when the transfer hoses 422 are disconnected and fallen away from the marine vessel 20 during emergency release. FIG. 5G shows a slack rope attached to an ERC 438 of a transfer hose 422, a transfer skid disposed 436 on the marine vessel 20, and QCDCs 439 of the transfer hoses 422 connected to the manifolds of the marine vessel 20 to establish fluid communication between the marine vessel 20 and the jack-up platform 10.

Figure 5H:
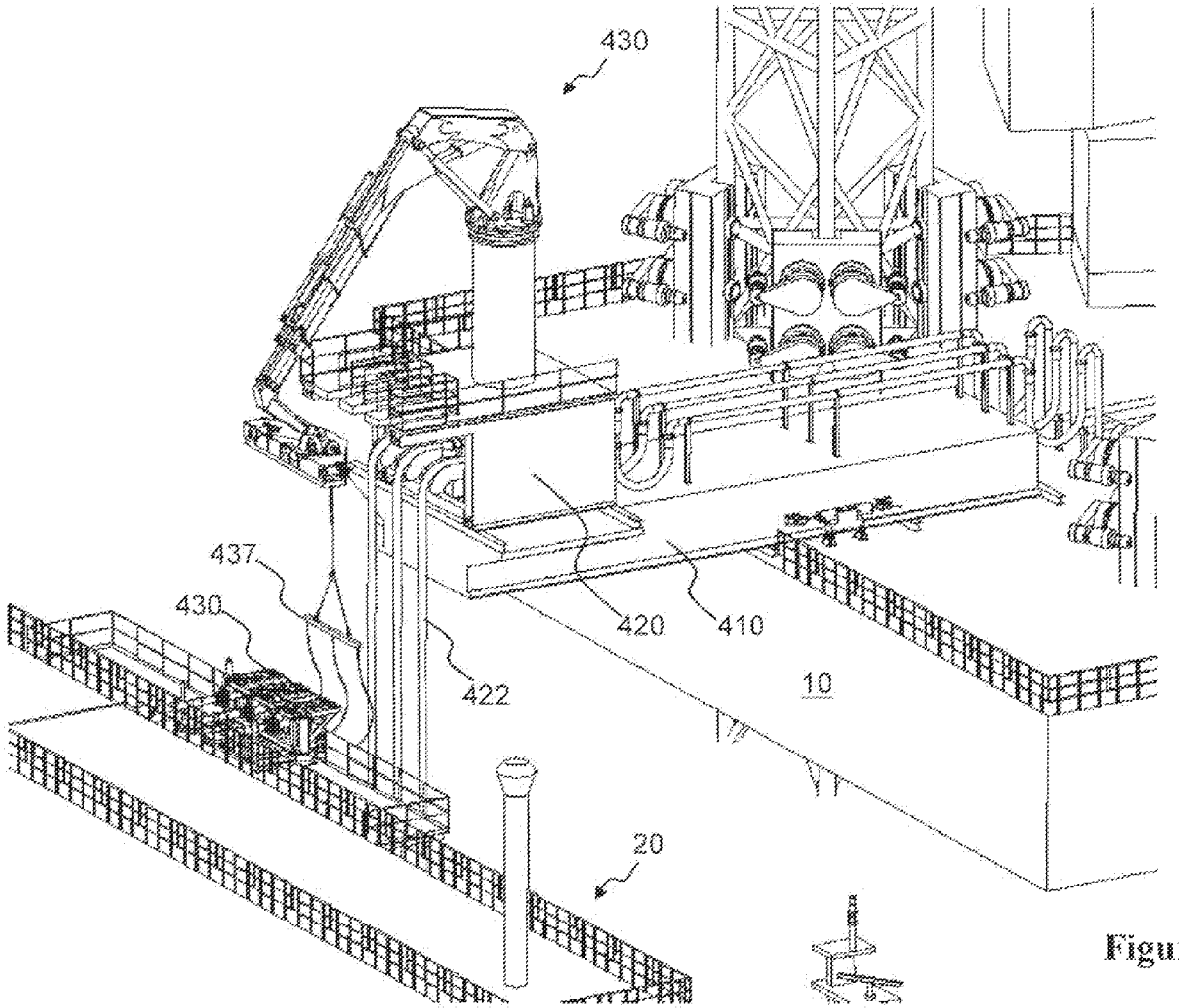
Figure 51:
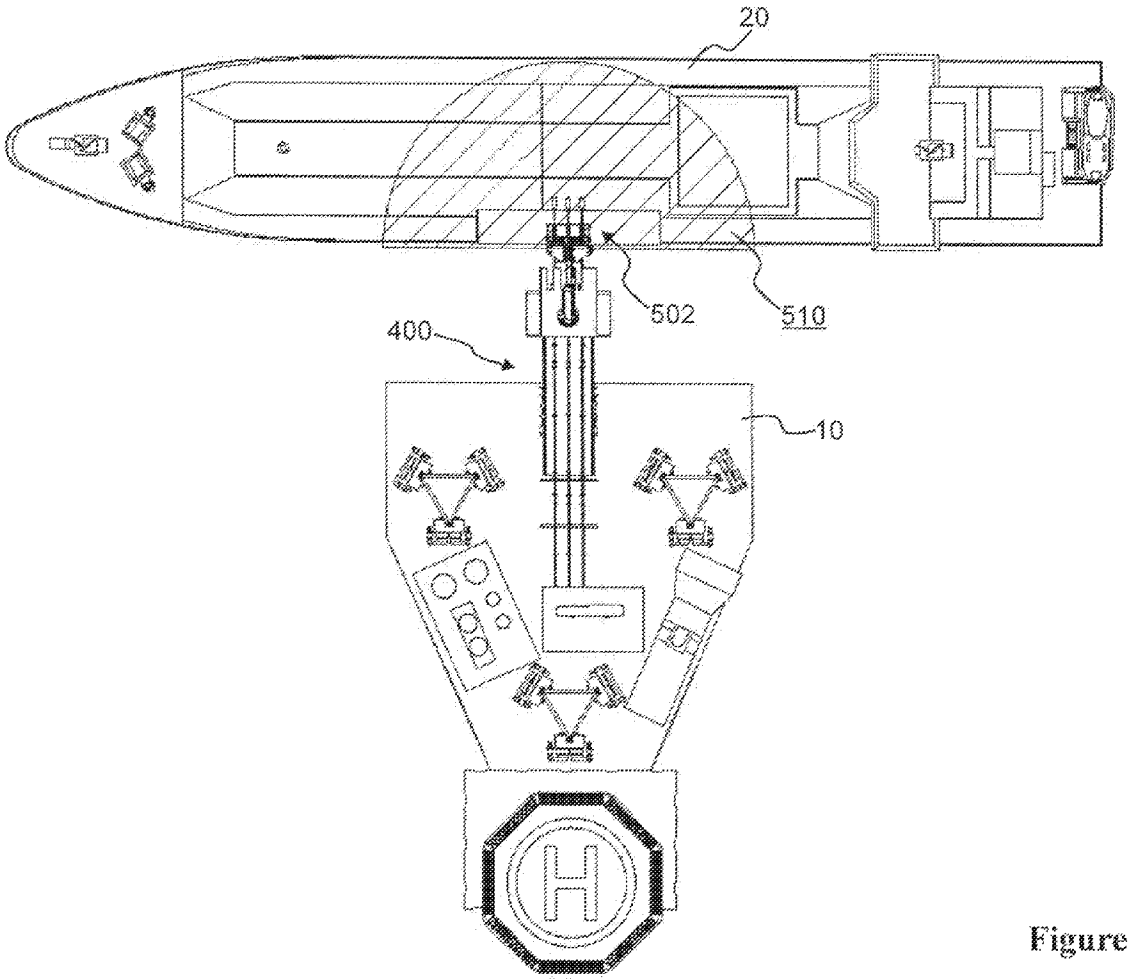

FIG. 5H illustrates the arrangement of the offloading system 400 when an offloading operation is taking place. During an offloading operation, the transfer hose handling system 430 supports a spreader bar 437 and slack ropes which are attached to the ERCs (not shown in FIG. 5H). If the ERCs 438 are disconnected and detached from the marine vessel 20, the detached transfer hoses 422 would be supported by the transfer hose handling system 430 via the spreader bar 437 and slack ropes.

FIG. 5I is a simplified top view of FIG. 5H and illustrates an original operating envelope 510 or reference position of an operating envelope of the offloading system 400. The original operating envelope 510 defines a maximum working region which the marine vessel 20 or a fluid transfer connection 502 between the marine vessel 20 and transfer hoses 422 is allowed to drift while an offloading operation can safely take place. If the marine vessel 20 or fluid transfer connection 502 moves to a position beyond the original operating envelope 510, an emergency shutdown of the offloading operation and/or disconnection of the offloading system 400 from the marine vessel 20 would have to take place.

Figure 5J:
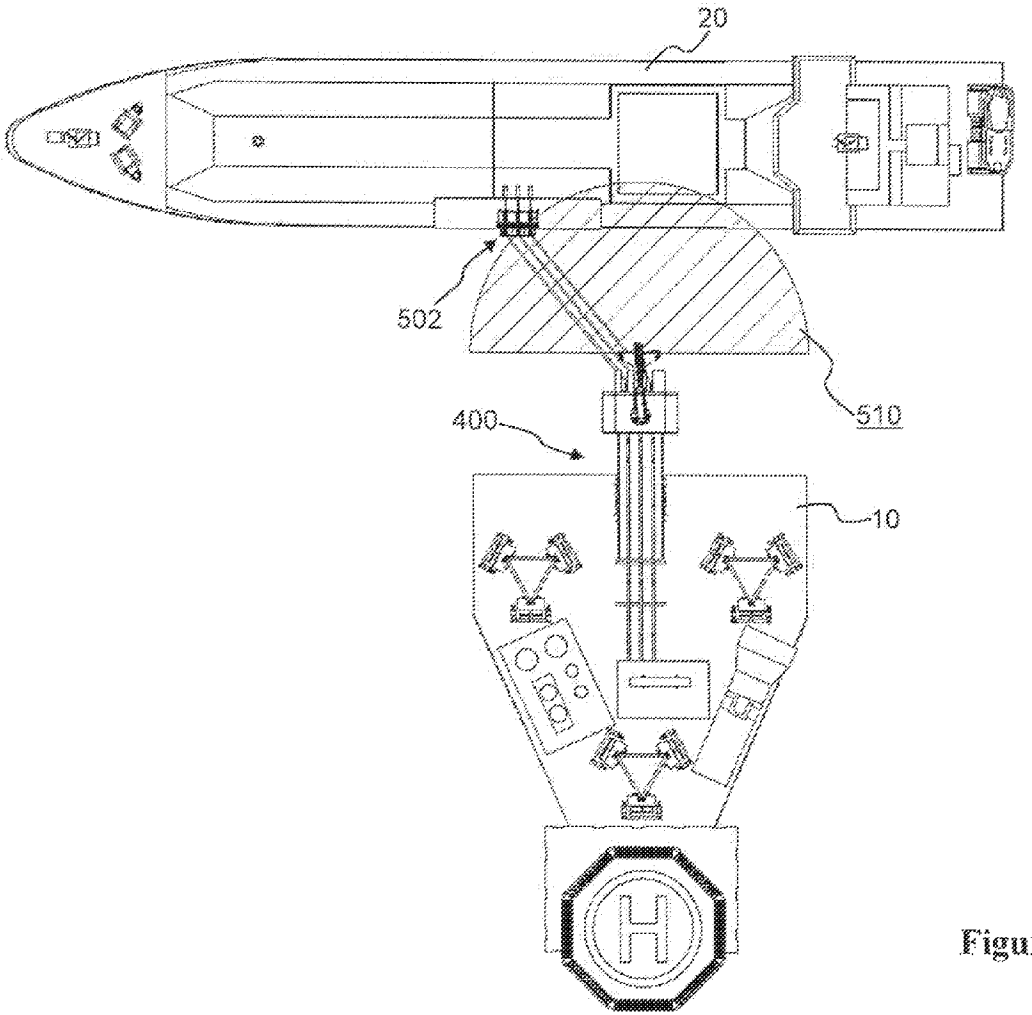

In FIG. 5J, it is shown that the marine vessel 20 has drifted from the original position illustrated in FIG. 5I to a new position relative to the jack-up platform 10 such that the marine vessel 20 or fluid transfer connection 502 is located at the edge of the working limit of the original operating envelope 510 illustrated in FIG. 5I.

Figure 5K:
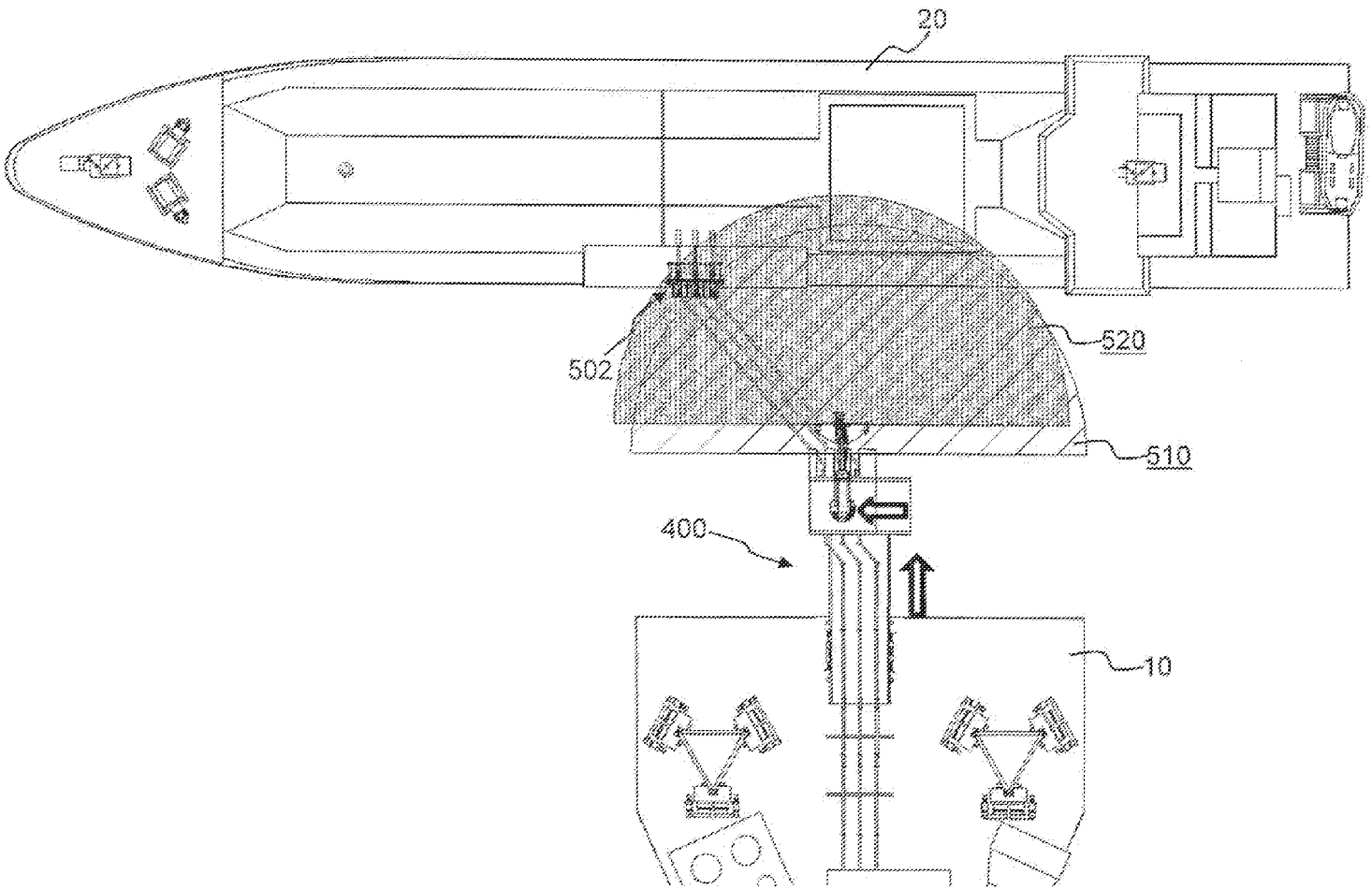

In anticipation of any further drifting of the marine vessel 20 or fluid transfer connection 502 beyond the original operating envelope 510, the original operating envelope 510 is displaced so that the drifted marine vessel 20 or displaced fluid transfer connection 502 remains located within the working limit of the new or displaced operating envelope. FIG. 5K illustrates a new or displaced operating envelope 520 to this purpose. Displacement of the operating envelope is achieved by moving the transverse platform 420 in the transverse (X) direction to adjust a transverse reach of the transverse platform and/or by moving the cantilever 410 in the longitudinal direction (Y) to adjust a longitudinal reach of the cantilever 410. If the drifted marine vessel 20 or fluid transfer connection 502 remains within the new or displaced operating envelope, emergency shutdown and disconnection of the offloading system from the marine vessel may be delayed or even refrained altogether. The offloading operation may continue without disruption while the drifted marine vessel 20 may be recovered to the original or pre-drifted position. After recovery of the marine vessel 20 to the original or pre-drifted position, the displaced operating envelope 520 may be returned to the original or pre-drifted operating envelope 510 by adjusting the reach of the cantilever 410 and/or transverse platform 420 accordingly.

Offshore environmental conditions can cause a marine vessel to drift from a desired position and this will result in sudden disruption to offloading operation. The disruption involves halting hydrocarbon fluid flow if the position of the drifted marine vessel exceeds the working limit of the original operating envelope. In certain instances, the ERCs of the transfer hoses are activated to disconnect the transfer hoses from the marine vessel if the position of the drifted marine vessel exceeds the allowable working limit of the operating envelope. Resuming hydrocarbon fluid flow and reconnecting transfer hoses to the marine vessel require multiple procedures which are time consuming. Accordingly, by displacing an operating envelope to a new position which will place a drifted marine vessel within limits of the new operating envelope, embodiments of the invention are advantageous in ensuring continuity of offloading operation without compromising on safety.

It will be appreciated that modifications may be made to the above disclosure in certain embodiments. While the present disclosure describes a fixed body as the first body and a moving body as the second body, the present disclosure also applies to two moving bodies, e.g. two marine vessels.

Other embodiments will be apparent to those skilled in the art from consideration of the specification and practice of the invention. Furthermore, certain terminology has been used for the purposes of descriptive clarity, and not to limit the disclosed embodiments of the invention. The embodiments and features described above should be considered exemplary, with the invention being defined by the appended claims.

What is claimed is:

1. An offloading system comprising:

a cantilever mounted on a deck, the cantilever is movable in a longitudinal direction of the cantilever between a retracted position and an extended position, the cantilever having an operational end which extends beyond the deck in the extended position;

a transverse platform mounted on the operational end of the cantilever and movable between a transverse direction of the cantilever;

a plurality of transfer hoses having a first end connected to a hydrocarbon fluid storage and having a second end to be connected to a marine vessel for fluid transfer between the hydrocarbon fluid storage and the marine vessel;

a transfer hose handling system mounted on the transverse platform and operable to manipulate the plurality of transfer hoses to and from the marine vessel;

a first plurality of rigid pipes disposed on the transverse platform and connected to the plurality of transfer hoses;

a second plurality of rigid pipes disposed on the cantilever;

a first plurality of flexible hoses connecting between the first and the second plurality of rigid pipes;

a third plurality of rigid pipes disposed on the deck; and a secondary plurality of flexible hoses connecting the second plurality of rigid pipes to the third plurality of rigid pipes, wherein after connecting the plurality of transfer hoses to the marine vessel, the transverse platform is movable in the transverse direction of the cantilever to adjust a transverse reach of the transverse platform and/or the cantilever is movable in the longitudinal direction of the cantilever to displace an operating envelope of the offloading system.

2. The offloading system of claim 1, wherein the offloading system is provided on a jack-up platform.

3. The offloading system of claim 1, wherein the offloading system is provided on a moving body.

4. A method for displacing an operating envelope of an offloading system, the method comprising:

positioning a marine vessel at a distance from a jack-up platform having an offloading system which comprises:

a cantilever mounted on a deck of the jack-up platform, the cantilever being movable in a longitudinal direction of the cantilever between a retracted position and an extended position, the cantilever having an operational end which extends beyond the deck in the extended position, a transverse platform mounted on the operational end of the cantilever and movable along a transverse direction of the cantilever, and a plurality of transfer hoses, each having a first end connected to a hydrocarbon fluid storage and each having a second end to be connected to the marine vessel for fluid transfer between the hydrocarbon fluid storage and the marine vessel;

a transfer hose handling system mounted on the transverse platform and operable to manipulate the plurality of transfer hoses to and from the marine vessel;

a first plurality of rigid pipes disposed on the transverse platform and connected to the plurality of transfer hoses;

a second plurality of rigid pipes disposed on the cantilever;

a first plurality of flexible hoses connecting between the first and the second plurality of rigid pipes;

a third plurality of rigid pipes disposed on the deck; and a second plurality of flexible hoses connecting the second plurality of rigid pipes to the third plurality of rigid pipes;

extending the operational end of the cantilever in the longitudinal direction towards the marine vessel;

connecting the plurality of transfer hoses to the marine vessel; and displacing an operating envelope of the offloading system by moving the transverse platform in the transverse direction to adjust a transverse reach of the transverse platform and/or by moving the cantilever in the longitudinal direction to adjust a longitudinal reach of the cantilever.

5. The method of claim 4, further comprising:

returning the marine vessel to a pre-drifted position; and returning the displaced operating envelope of the offloading system to the pre-drifted position by moving the transverse platform in the transverse direction to adjust a transverse reach of the transverse platform and/or by moving the cantilever in the longitudinal direction to adjust a longitudinal reach of the cantilever.

* * * * *